US008037795B2

(12) United States Patent
Matthes et al.

(10) Patent No.: US 8,037,795 B2
(45) Date of Patent: Oct. 18, 2011

(54) TRIMMER FOR TRIMMING BROCHURES

(75) Inventors: Wolfgang Matthes, Kühren-Burkartshain (DE); Falk Wagner, Beucha (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1042 days.

(21) Appl. No.: 11/093,463

(22) Filed: Mar. 30, 2005

(65) Prior Publication Data

US 2005/0217453 A1 Oct. 6, 2005

(30) Foreign Application Priority Data

Mar. 30, 2004 (DE) ..... 10 2004 015 591

(51) Int. Cl.
*B26D 1/06* (2006.01)
*B26D 7/26* (2006.01)

(52) U.S. Cl. ..... 83/560; 83/694; 83/699.41; 83/934

(58) Field of Classification Search ..... 83/560, 83/240, 516, 517, 558, 559, 613, 679, 694, 83/695, 699.31, 699.41, 699.51, 699.61, 83/904, 933, 934
See application file for complete search history.

(56) References Cited

U.S. PATENT DOCUMENTS

| | | | | | |
|---|---|---|---|---|---|
| 1,044,861 | A | * | 11/1912 | Cox | 83/459 |
| 2,582,094 | A | * | 1/1952 | Balsam et al. | 83/560 |
| 2,908,303 | A | * | 10/1959 | Schmidt, Jr. | 269/10 |
| 3,198,052 | A | * | 8/1965 | Persson | 83/516 |
| 3,540,340 | A | * | 11/1970 | Koskela | 83/499 |
| 4,144,785 | A | * | 3/1979 | von Langendorff | 83/685 |
| 4,484,501 | A | | 11/1984 | Ramcke | 83/255 |
| 4,623,089 | A | * | 11/1986 | Scott | 234/114 |
| 4,922,773 | A | | 5/1990 | Ito | 83/76.6 |
| 2002/0092394 | A1 | | 7/2002 | Rathert | 83/213 |

FOREIGN PATENT DOCUMENTS

| | | | |
|---|---|---|---|
| DE | 720 220 | | 4/1942 |
| DE | 33 00 999 | A1 | 9/1983 |
| DE | 41 13 797 | A1 | 11/1991 |
| DE | 41 39 137 | A1 | 6/1993 |
| DE | 101 01 843 | A1 | 7/2002 |
| EP | 0 485 542 | B1 | 10/1995 |
| GB | 2 262 713 | A | 6/1993 |
| JP | 2003 300 191 | | 10/2003 |

* cited by examiner

*Primary Examiner* — Clark F. Dexter
(74) *Attorney, Agent, or Firm* — Laurence A. Greenberg; Werner H. Stemer; Ralph E. Locher

(57) ABSTRACT

A trimmer for trimming brochures has lower blade holders and upper blade holders for top cutting blades and bottom cutting blades lying opposite them. The trimmer further has a guide rail configuration and tensioners by which the lower blade holders can be locked on the guide rail configuration. Accordingly, the tensioners can be actuated from one and the same side of the trimmer. This has an advantageous effect on the time required for changing over the trimmer from one brochure format to another.

5 Claims, 4 Drawing Sheets

TRIMMER FOR TRIMMING BROCHURES

BACKGROUND OF THE INVENTION

Field of the Invention

The invention relates to a trimmer for trimming brochures. The trimmer has lower blade holders and upper blade holders for top cutting blades and bottom cutting blades lying opposite them, a guide rail configuration, and tensioners. The tensioners are used for locking the lower blade holders on the guide rail configuration.

Trimmers of this type have been marketed by the applicant as a respective component part of gathering and stitching machines having the type designations ST100 and ST300. The above mentioned guide rail configuration and the tensioners serve to adapt the top and bottom cutting blades to the spine length of the brochures which is to be produced. The duration of this adaptation is part of the fitting time, within which gathering and stitching machines that contain trimmers have to be changed over from one brochure format to another.

SUMMARY OF THE INVENTION

It is accordingly an object of the invention to provide a trimmer for trimming brochures which overcomes the above-mentioned disadvantages of the prior art devices of this general type, which keeps the time required for changing over a post-treatment printing machine having the trimmer, for example a gathering and stitching machine, from one brochure format to another, as short as possible.

With the foregoing and other objects in view there is provided, in accordance with the invention, a trimmer for trimming brochures. The trimmer contains lower blade holders, upper blade holders, and top cutting blades and bottom cutting blades disposed on the upper and lower blade holders and across from each other. A guide rail configuration is provided. Tensioners are provided for locking the lower blade holders on the guide rail configuration. The tensioners are actuated from one and the same side of the trimmer.

In order to achieve the object, there is provision for the tensioners of the trimmer mentioned in the introduction to be actuable from one and the same side. This has a favorable effect on the time required for changeover, insofar as a path is saved for the tool setter, which path is necessary in the trimmer mentioned in the introduction and belonging to a gathering and stitching machine, insofar as a tensioner for a blade holder which bears an upper blade for top trimming and a tensioner for a blade holder which bears a lower blade for bottom trimming are accessible there only from mutually opposite sides of the trimmer. If no bridge is provided for this purpose in the case of an interlinked assembly, long paths can namely be required in order to pass from one side of the trimmer to the opposite side of the trimmer. Even walking over a bridge that might be provided takes time. However, this time is saved using a configuration of a trimmer mentioned in the introduction according to the present invention.

Other features which are considered as characteristic for the invention are set forth in the appended claims.

Although the invention is illustrated and described herein as embodied in a trimmer for trimming brochures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
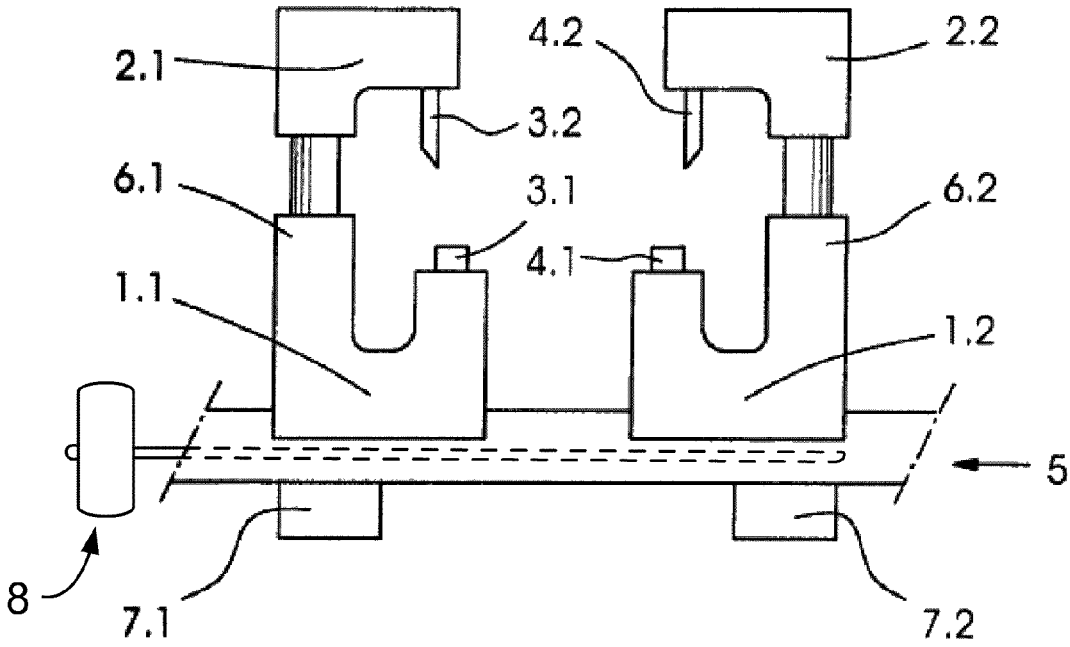
FIG. 1 is a diagrammatic illustration of upper blade holders and lower blade holders for top cutting blades and bottom cutting blades which can be placed along a guide rail configuration according to the invention.

Referring now to the figures of the drawing in detail and first, particularly, to FIG. 1 thereof, there is shown a trimmer that includes lower blade holders 1.1 and 1.2 and upper blade holders 2.1 and 2.2 for top cutting blades 3.1 and 3.2 and bottom cutting blades 4.1 and 4.2. The lower blade holders 1.1 and 1.2 are placed onto a guide rail configuration 5 and form guides 6.1 and 6.2 for the upper blade holders 2.1 and 2.2. In order to adapt the top cutting blades 3.1 and 3.2 and the bottom cutting blades 4.1 and 4.2 to the spine length of the respective brochure which is to be produced, the lower blade holders 1.1 and 1.2 can be displaced along the guide rail configuration 5, and to be precise in a state which is released from tensioners (7, not illustrated in FIG. 1) which, in a tensioned state, lock the lower blade holders 1.1 and 1.2 with regard to the guide rail configuration 5. In this locked state, the tensioners cause a tensile force between the respective lower blade holder 1.1 and 1.2 on one side and a respective clamping strip 7.1 and 7.2 (which are assigned to the guide rail configuration 5 on a side facing away from the lower blade holders 1.1 and 1.2) on the other side. The tensile force leads to a frictional connection between the guide rail configuration 5 and the respective lower blade holder 1.1 and 1.2.

Figure 2:
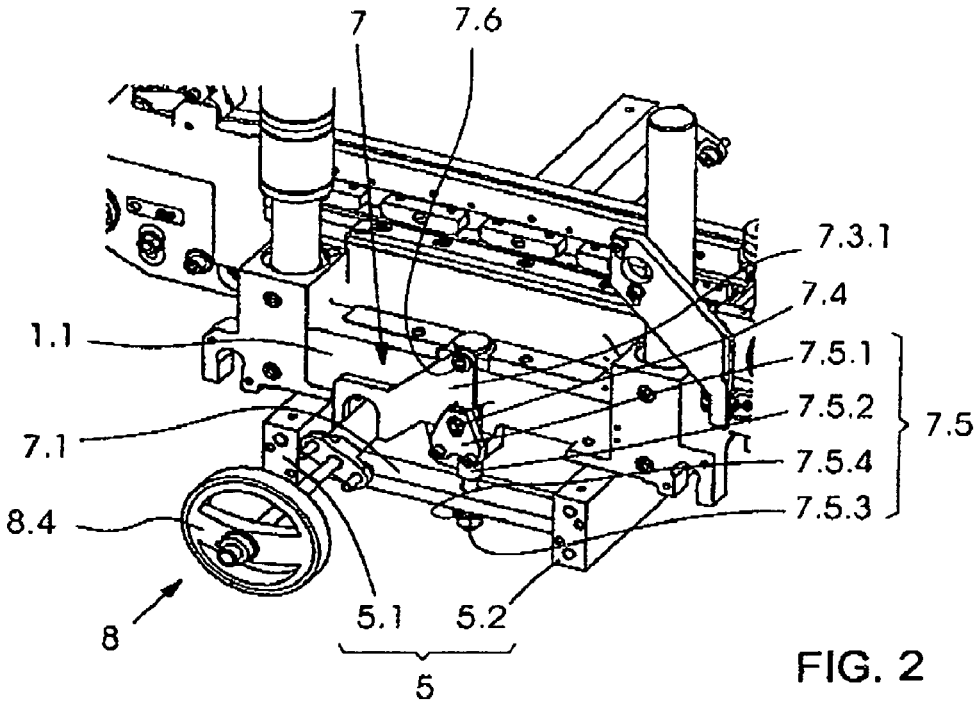
FIG. 2 is a diagrammatic, perspective view of a lower blade holder that has been placed on the guide rail configuration, a tensioner which is provided to lock the lower blade holder, and an actuator which interacts with the tensioner.

FIG. 2 shows, as a detail from a trimmer, the guide rail configuration 5 which is formed from two guide rails 5.1 and 5.2 in the present exemplary embodiment. The lower blade holder 1.1 is placed on the guide rail configuration 5 and faces an operating side of the trimmer. A tensioner 7 is configured on the guide rail configuration 5 in order to lock the lower blade holder 1.1, and an actuator 8 interacts with the tensioner 7. A substantially identical configuration is provided for the second lower blade holder 1.2 that can be seen from FIG. 1 as for the lower blade holder 1.1 which can be seen in FIG. 2. However, in the case of a separate actuator for the tensioner which is assigned to the second lower blade holder 1.2, only the length of the actuator deviates from this, as the actuator extends here from its working location on the other side of the lower blade holder 1.1 which can be seen in FIG. 2 beyond the latter as far as an actuating location which lies spatially in the vicinity of that actuating location, at which the tensioner 7 for the lower blade holder 1.1 which faces the operating side (see FIG. 2) is actuated.

To this extent, the tensioners 7 of both lower blade holders 1.1 and 1.2, that is to say the lower blade holder for top trimming and the lower blade holder for bottom trimming, can be actuated from one and the same side of the trimmer.

In a preferred refinement, a common actuator 8 is provided for the tensioner 7 of both lower blade holders 1.1 and 1.2.

A respective tensioner contains a displaceable tensioning cam 7.3 (see FIG. 3), a cam follower 7.4 which interacts with the tensioning cam 7.3, and a tensioning device 7.5 which is connected to the cam follower 7.4. It is possible for the cam follower 7.4 to be configured as a bolt or a roller.

The tensioning cam 7.3 is displaceable to the extent that it (in the form of a slotted guide) is machined into a pivoting part 7.3.1 (in the form of a plate here) which for its part is suspended on the lower blade holder 1.1 by a joint 7.6 and can thus be pivoted.

In the present exemplary embodiment, the cam follower 7.4 which interacts with the tensioning cam 7.3 is a bolt which is disposed on the tensioning device 7.5 and engages into the above mentioned slotted guide which forms the tensioning cam 7.3.

In the present exemplary embodiment, the tensioning device 7.5 is of multipart configuration and contains a tensioning plate 7.5.1 which bears the cam follower 7.4 which is configured in the form of the above mentioned bolt, and a shaped part which can be screwed to the tensioning plate and forms a tensioning shaft 7.5.2 which penetrates the clamping strip 7.1 which is assigned to the lower blade holder 1.1 and, at one shaft end which penetrates the clamping strip 7.1 and then projects beyond it, has a tensioning head 7.5.3 which is, for example, screwed on, fixed by a locknut and supported on the clamping strip 7.1 via a spring assembly 7.5.4.

The center axes of a joint 7.6, of the bolt that forms the cam follower 7.4, and of the tensioning shaft 7.5.2 preferably lie in one and the same vertical plane.

Figure 4:
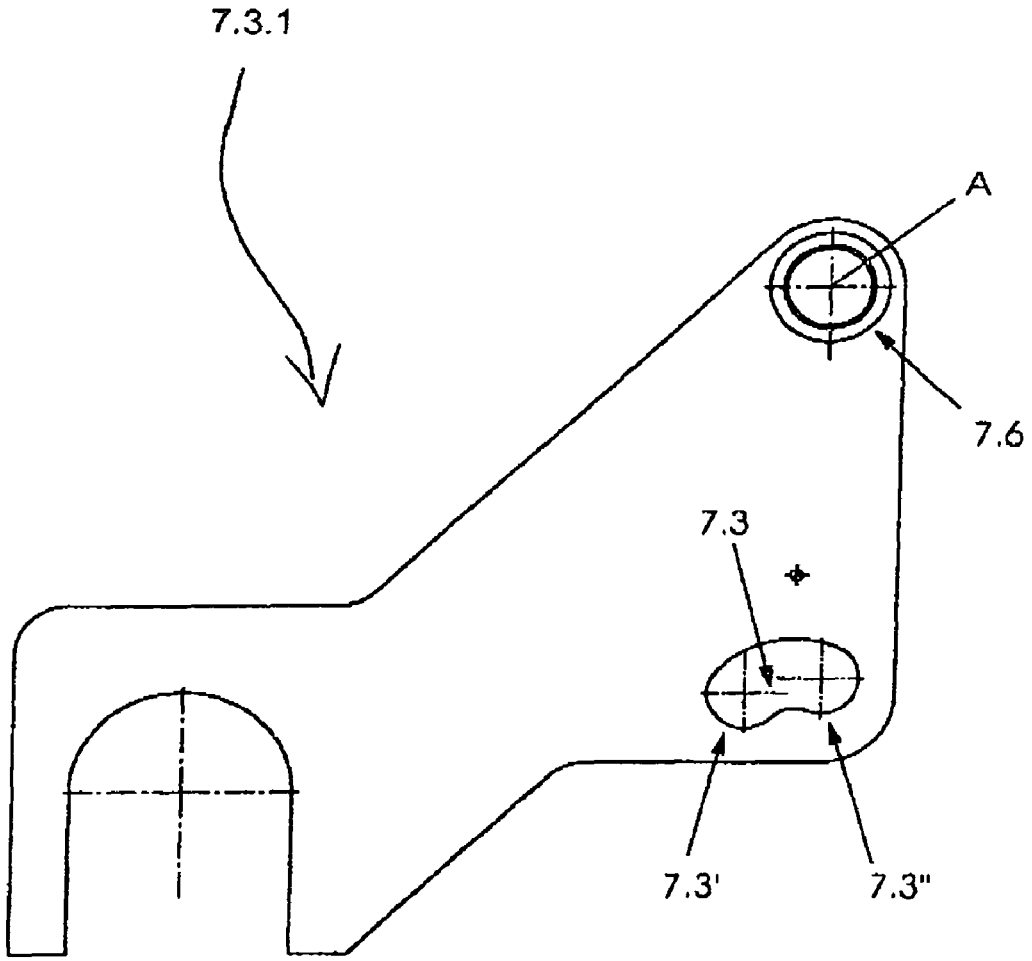
FIG. 4 is a diagrammatic, side-elevation view of a detail of a portion of the tensioner according to FIGS. 2 and 3.

FIG. 4 shows the pivoting part 7.3.1 that belongs to the tensioner 7 and the joint 7.6 that is provided for its suspension, and shows, in particular, a preferred configuration of the tensioning cam 7.3.

Figure 3:
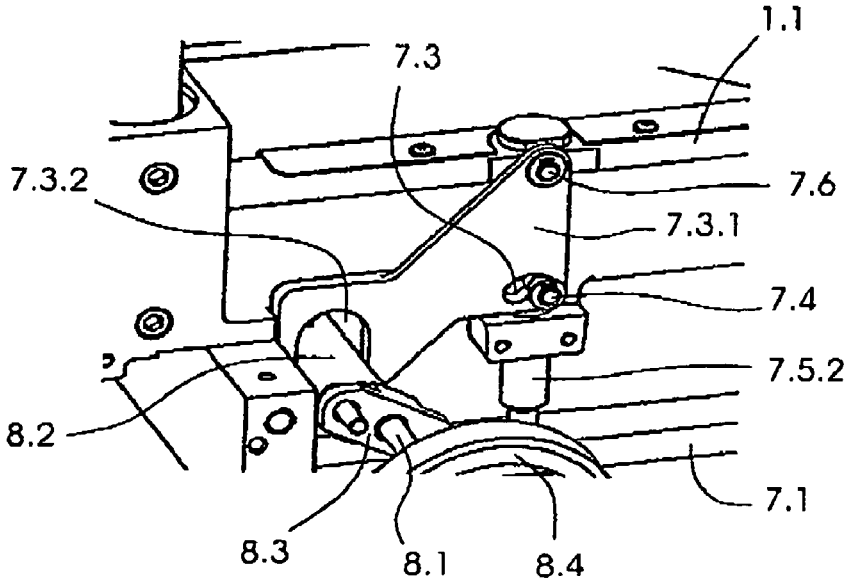
FIG. 3 is a diagrammatic, perspective view of the subject matter according to FIG. 2, in a simplified illustration.

In FIGS. 2, 3 and 4, the pivoting part 7.3.1 is in a pivoting position that corresponds to a tensioned state of the tensioner 7. For the bolt which forms the cam follower 7.4, the tensioning cam 7.3 contains a first latching depression 7.3' for an untensioned state and a second latching depression 7.3", which lies higher than the first one, for the tensioned state of the tensioner 7.

As can be seen, the second latching depression 7.3" is disposed in such a way that, even in the tensioned state of the tensioner 7, the center axis of the bolt which forms the cam follower 7.4 lies in the abovementioned vertical plane in which the pivot axis A of the joint 7.6 also lies, about which pivot axis A the pivoting part 7.3.1 can be pivoted.

In the refinement of the tensioner 7 according to FIGS. 2 and 3, the actuator 8 for bringing about a tensioned and an untensioned state by appropriate pivoting of the pivoting part 7.3.1 with regard to the joint 7.6 is a tensioning shaft 8.1 which engages into a slot 7.3.2 provided in the pivoting part 7.3.1 with an eccentric 8.2 formed on the tensioning shaft 8.1. The slot 7.3.2 extends in a direction that is substantially parallel to the abovementioned vertical plane which is defined by the center axes of the joint 7.6, of the cam follower 7.4 and of the tensioning shaft 7.5.2.

In the present exemplary embodiment, the tensioning shaft 8.1 is rotatably mounted at one respective end in a flange 8.3 that for its part is fastened to a non-illustrated frame. The tensioning shaft 8.1 is connected fixedly to a handwheel 8.4 so as to rotate with it on one side of the trimmer. To this extent, the lower blade holders 1.1 and 1.2 can be clamped and released without tools by appropriate manual rotation of the handwheel 8.4. For this purpose, the tensioning shaft 8.1 has the continuous eccentric 8.2, or one eccentric 8.2 for each respective tensioner 7, for engagement into corresponding slots 7.3.2 in the pivoting parts 7.3.1 belonging to the tensioners 7 for the lower blade holders 1.1 and 1.2.

Figure 5:
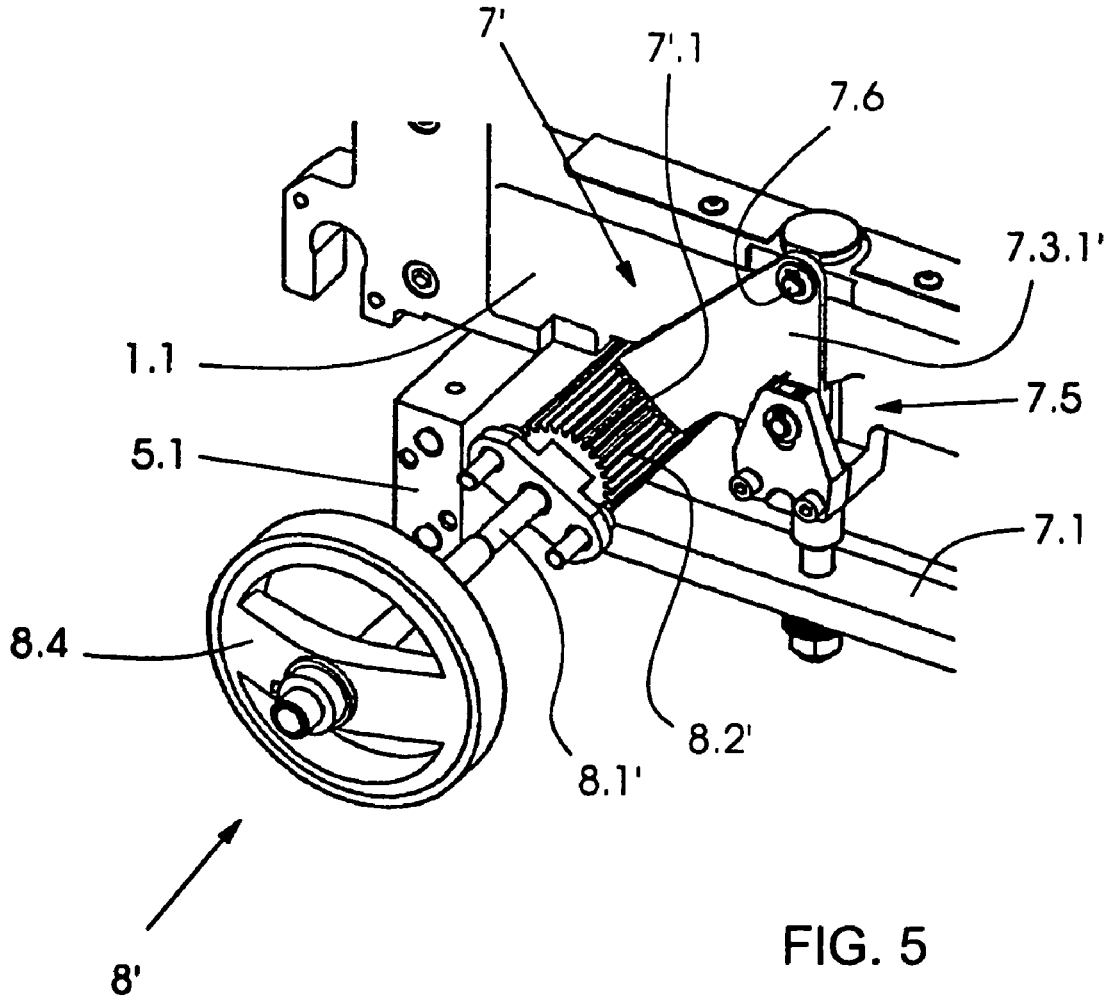
FIG. 5 is a diagrammatic, perspective view of an alternative refinement of the tensioner to those according to FIGS. 2 and 3.

The respective pivoting part 7.3.1, the respective tensioning device 7.5 which is connected to the pivoting part 7.3.1 via one of the cam followers 7.4, and the respectively associated clamping strip 7.1 or 7.2 form a tie rod, as can be seen, by which the respective lower blade holder 1.1 or 1.2 can be pressed against the guide rail configuration 5. FIG. 5 shows an alternative refinement of a tensioner 7', in which the tensioning force is introduced via a toothing system. For this purpose, a pivoting part 7.3.1', which otherwise corresponds to the pivoting part 7.3.1 and has a tooth segment 7' 0.1 which is concentric with respect to the joint 7.6, and an actuator 8' are provided, which actuator 8' deviates from the actuator 8 and from its configuration on the trimmer only to the extent that, instead of the tensioning shaft 8.1 which has eccentrics 8.2, it has a tensioning shaft 8.1' which is provided with toothing 8.2' which meshes with the tooth segment 7'.1.

In the exemplary embodiments which have been explained to this extent and have a displaceable tensioning cam 7.3, a cam follower 7.4 which interacts with the tensioning cam 7.3, and a tensioning device 7.5 which is connected to the cam follower 7.4, the tensioning cam 7.3 is displaced by pivoting a component which forms the tensioning cam 7.3. However, it goes without saying that a translatory displacement of a tensioning cam also lies within the scope of the invention. Furthermore, of course, other mechanisms than the ones shown for pivoting a pivoting part that has a tensioning cam also lie within the scope of the invention.

Furthermore, tensioning cams of different types than that already described also lie within the scope of the invention. The shape of the tensioning cam 7.3 provided in the exemplary embodiments shown results, however, in an advantageous manner, in the tensioner 7 or 7' not exerting any reaction effect on the actuator 8 or 8' in the tensioned state of the tensioner 7 or 7', as the line of action of the tensioning force lies in the abovementioned vertical plane defined by the pivot axis A of the joint 7.6, the center axis of the cam follower 7.4 and the longitudinal axis of the tensioning shaft 7.5.2, and the tensioning force thus has no transverse force component which acts on the actuator 8 or 8'.

This application claims the priority, under 35 U.S.C. §119, of German patent application No. 10 2004 015 591.7, filed Mar. 30, 2004; the entire disclosure of the prior application is herewith incorporated by reference.

We claim:

1. A trimmer for trimming brochures, comprising:

a top cutter and a bottom cutter, each cutter having a lower blade holder and an upper blade holder operatively connected to the lower blade holder, said top cutter having top cutting blades and said bottom cutter having bottom cutting blades;

said top and bottom cutting blades disposed on said upper and lower blade holders and across from each other, each of the top and bottom cutting blades having an elongated cutting edge to top trim and bottom trim a brochure, respectively;

a guide rail configuration extending generally orthogonally to said cutting edges;

said top and bottom cutters each having a tensioner for locking said lower blade holders in a selected position on said guide rail configuration, said tensioners being actuated from one and the same side of the trimmer by an actuator, wherein said actuator is mechanically connected to said tensioners to actuate said tensioners;

each said tensioner including:

a displaceable tensioning cam formed as a slotted guide, a cam follower interacting with said tensioning cam, and a tensioning device connected to said cam follower that provides said locking of said lower blade holders with said guide rail configuration.

2. The trimmer according to claim 1, further comprising an actuator acting on said tensioners, said actuator being common to said tensioners.

3. The trimmer according to claim 1, wherein a respective one of said tensioners forms a tie rod, by said tie rod a respective one of said lower blade holders can be pressed against said guide rail configuration.

4. The trimmer according to claim 1, wherein each said tensioning cam is part of a pivoting part, wherein said pivoting part is disposed pivotably on a respective one of said lower blade holders.

5. A trimmer for trimming brochures, comprising:

a top cutter and a bottom cutter, each cutter having a lower blade holder and an upper blade holder operatively connected to the lower blade holder, said top cutter having top cutting blades and said bottom cutter having bottom cutting blades;

said top and bottom cutting blades disposed on said upper and lower blade holders and across from each other, each of the top and bottom cutting blades having an elongated cutting edge to top trim and bottom trim a brochure, respectively;

a guide rail configuration extending generally orthogonally to said cutting edges;

said top and bottom cutters each having a tensioner for locking said lower blade holders in a selected position on said guide rail configuration, said tensioners being actuated from one and the same side of the trimmer by an actuator;

said actuator including a tensioning shaft having an eccentric; and each said tensioner having a pivoting part being disposed on said respective lower blade holder and pivoted by said tensioning shaft having said eccentric to lock or release said lower blade holders.

* * * * *